United States Patent [19]

Barrett

[11] Patent Number: 4,728,089

[45] Date of Patent: Mar. 1, 1988

[54] CLOTH SPREADING APPARATUS

[75] Inventor: Robert C. Barrett, Angola, N.Y.

[73] Assignee: Eastman Machine Company, Buffalo, N.Y.

[21] Appl. No.: 901,304

[22] Filed: Aug. 28, 1986

[51] Int. Cl.[4] ..... B65H 29/46; B65H 25/22

[52] U.S. Cl. ..... 270/31; 226/38; 242/75.43; 242/58.6

[58] Field of Search ..... 270/30–31, 270/39; 226/38, 45; 242/181, 56 B, 58.6, 62, 75.2, 75.4, 75.43

[56] References Cited

U.S. PATENT DOCUMENTS

| | | | |
|---|---|---|---|
| 3,094,319 | 6/1963 | Deichmann | 270/31 |
| 3,233,488 | 2/1966 | Deichmann | 83/174 |
| 3,630,463 | 12/1971 | Mistele | 242/75.43 |
| 3,645,524 | 2/1972 | Grimm et al. | 270/31 |
| 3,782,649 | 1/1974 | Frederick et al. | 270/31 |
| 3,974,948 | 8/1976 | Kroppenstedt | 226/38 |
| 4,033,522 | 7/1977 | Chesnut et al. | 242/75.4 |
| 4,134,558 | 1/1979 | Grillo | 242/75.4 |
| 4,193,589 | 3/1980 | Frederick | 270/31 |
| 4,339,118 | 7/1982 | Burton et al. | 270/31 |
| 4,462,583 | 7/1984 | Smith et al. | 270/31 |
| 4,477,065 | 10/1984 | Smith et al. | 270/31 |
| 4,573,618 | 3/1986 | Kikuchi | 226/42 |
| 4,575,065 | 3/1986 | Jung et al. | 270/31 |
| 4,575,066 | 3/1986 | Nasu | 270/31 |
| 4,595,328 | 6/1986 | Seitz et al. | 242/58.6 |
| 4,606,533 | 8/1986 | Fonio | 270/31 |

FOREIGN PATENT DOCUMENTS

| | | | |
|---|---|---|---|
| 2825741 | 12/1979 | Fed. Rep. of Germany | 242/58.6 |
| 1139651 | 7/1957 | France | 242/58.6 |
| 1420568 | 11/1965 | France | 242/58.6 |

OTHER PUBLICATIONS

Brochure—"SME Patriot EAGLE Features", Spreading Machine Exchange Inc., 1986.

Brochure—"Niebuhr Fully Automatic Turntable", Niebuhr A/S, 1985.

*Primary Examiner*—E. H. Eickholt

*Attorney, Agent, or Firm*—Christel, Bean & Linihan

[57] ABSTRACT

A cloth spreading apparatus 10 for spreading cloth from a cloth roll 16 supported by an expandable mandrel 20 onto a work surface 14. The apparatus includes a carriage assembly 24 movable on the work surface between first and second locations. A mounting frame assembly 26 is carried by the carriage and includes a shiftable subframe 118, 120, 122, 124, 126 and 128, a first pivotal portion 94 supported on the subframe and a second portion 96 rotatable 180°, the second portion being carried by the pivotal portion. A shifting motor 74 is provided to shift the subframe in response to a cloth edge sensing apparatus 58. A motor driven screw operated scissors jack assembly 102 is provided to pivot the pivotal portion. A cantilevered spring 200 is disposed between the pivotal portion and the rotatable portion and initially accelerates and then decelerates the rotatable portion as it moves 180° from one position to another. An electric prefeed motor 210 drives an output gear 208 engageable with a spur gear 212 on the mandrel, the motor prefeeding or dynamically braking the cloth roll assembly in response to cloth tension sensing means 66 on the carriage assembly.

36 Claims, 11 Drawing Figures

Fig. 6.
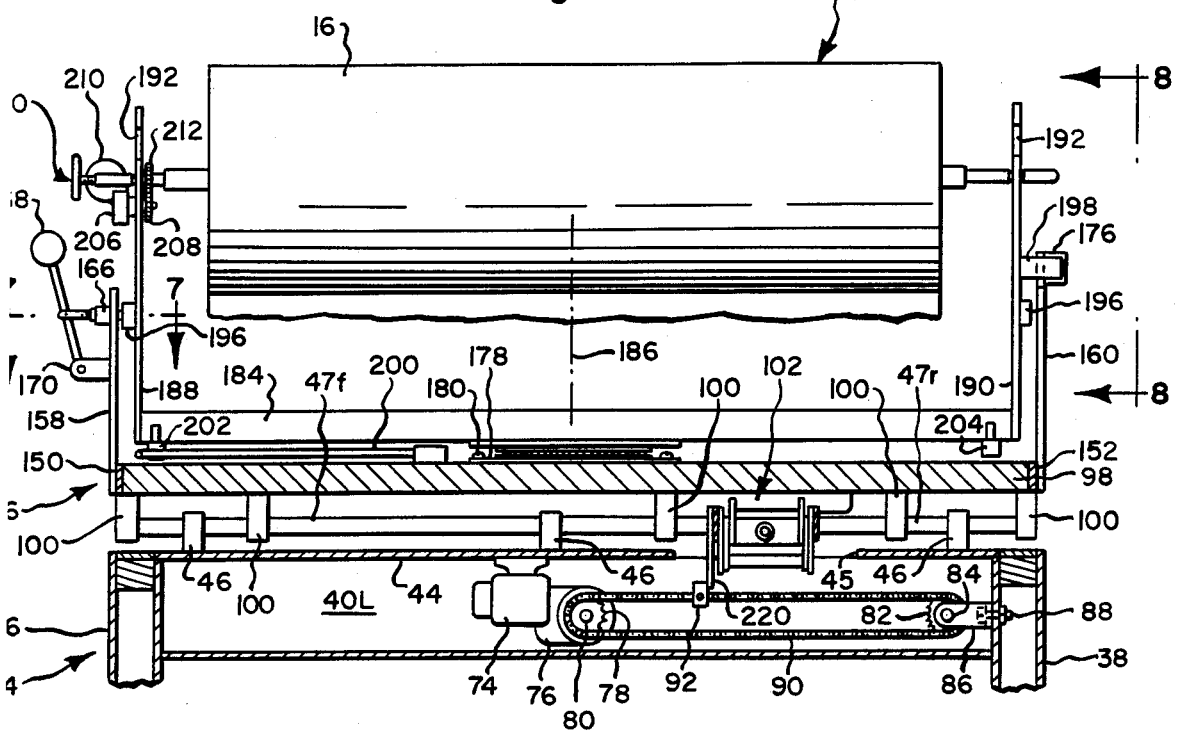
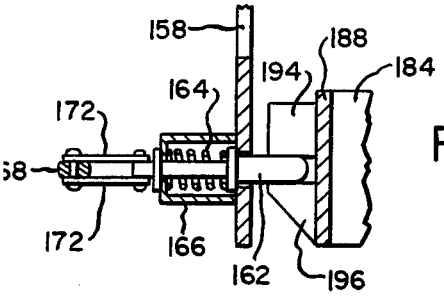
Fig. 7.
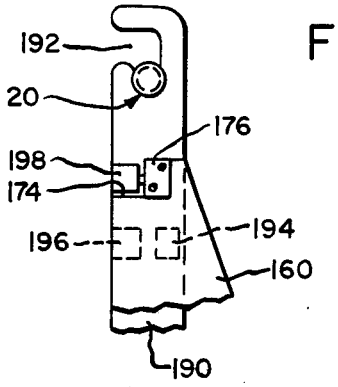
Fig. 8.
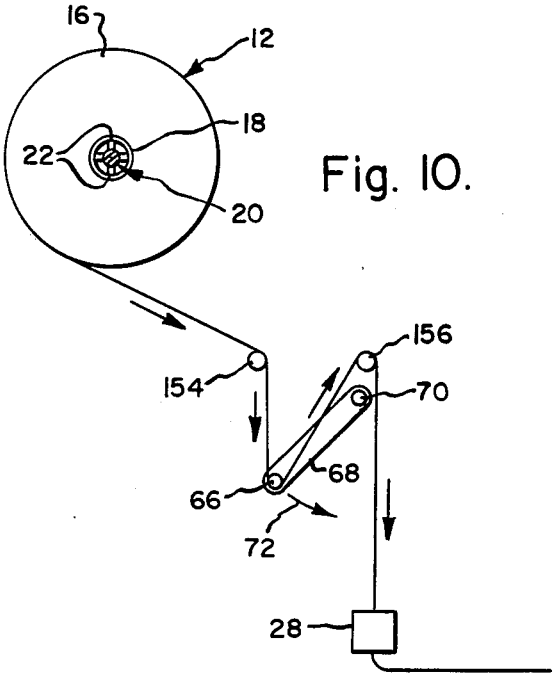
Fig. 10.
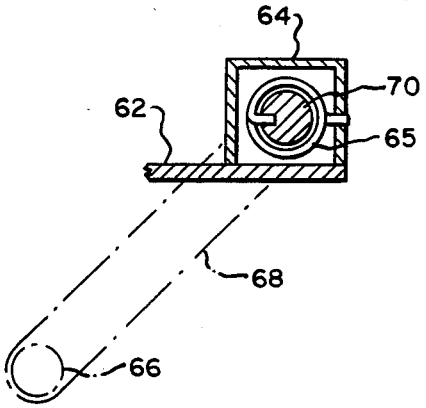
Fig. 9.

CLOTH SPREADING APPARATUS

TECHNICAL FIELD

The present invention relates generally to a cloth spreading apparatus and more particularly to a novel cloth spreading apparatus having an improved roll mounting frame assembly carried by a mountable carriage assembly, the mounting frame assembly including an improved cloth roll assembly loader, an improved turntable, an improved prefeed motor having dynamic braking capabilities, and other novel features.

BACKGROUND OF THE INVENTION

Prior art cloth spreading machines are well known in the are and one typical example is shown in U.S. Pat. No. 3,233,488 issued Feb. 8, 1966. Machines of the type shown in U.S. Pat. No. 3,233,488, as well as other machines, have been provided with such features as loaders for cloth roll assemblies, turntables, edge guides, and other related features. However, while many of these features have worked satisfactorily in the past, it has not been practical to combine some of these features, and additional individual features require complex and costly mechanisms for their operations.

OBJECTS OF THE PRESENT INVENTION

It is an object of the present invention to provide an improved cloth spreading apparatus having an improved cloth roll assembly loading apparatus of a simplified construction.

It is another object of the present invention to provide a cloth spreading apparatus with an improved turntable upon which a cloth roll assembly is mounted.

It is a further object of the present invention to provide an cloth spreading apparatus with an improved prefeed and dynamic braking motor assembly.

It is a further object of the present invention to provide an improved cloth spreading apparatus provided with an edge guide mechanism which can be utilized in combination with the preceding features.

It is a further object of the preset invention to provide an improved turntable construction and an improved cloth roll assembly loading apparatus which can be used together.

It objects set forth above, as well as additional objects and advantages of this invention, will become apparent after a consideration of the following detailed description taken in conjunction with the accompanying drawings in which a preferred form of this invention is illustrated.

BRIEF DESCRIPTION OF THE DRAWINGS

FIG. 6 is a section taken generally along the line 6—6 in FIG. 2.

FIGS. 7 and 8 are views taken generally along the lines 7—7 and 8—8 in FIG. 6.

FIG. 9 is a view taken generally along the line 9—9 in FIG. 3.

FIG. 10 is a somewhat schematic view illustrating the manner in which the cloth is fed to the work surface when the apparatus is moving to the left when viewed in FIG. 1.

DETAILED DESCRIPTION

In the following detailed description, front and rear references, as well as right and left references, will refer to the view shown in FIG. 1. These references are for convenience only and should not be considered to be limiting.

Figure 1:
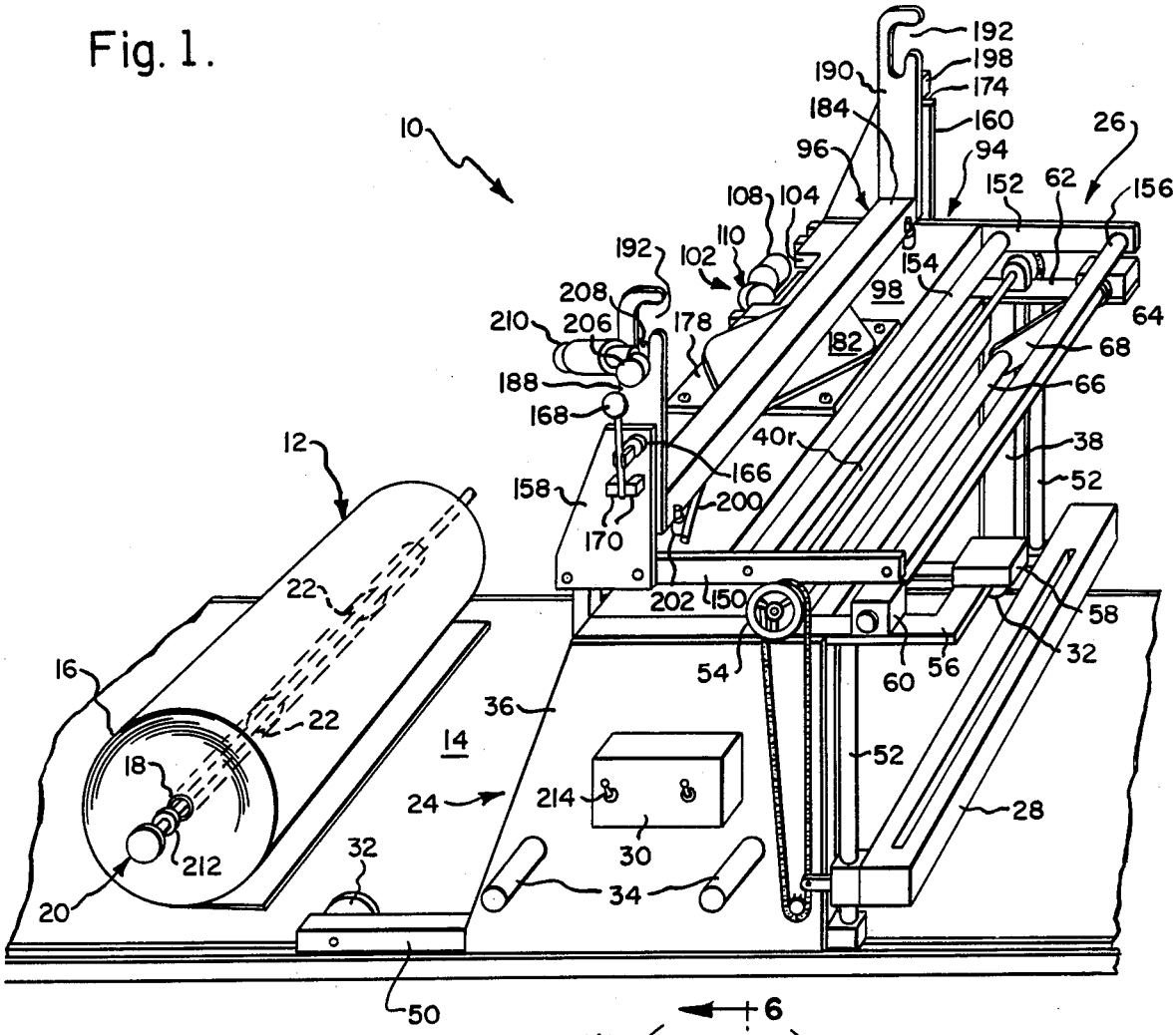
FIG. 1 is a perspective view of the cloth spreading apparatus of the present invention showing the turntable portion in a first position and additionally showing a cloth roll assembly prior to loading onto the apparatus.

Referring first to FIG. 1, the cloth spreading apparatus of this invention is indicated generally at 10. The cloth spreading apparatus is capable of spreading a plurality of superimposed layers of cloth from a cloth roll assembly, indicated generally at 12, onto a transversely extending work surface 14. The work surface 14 is generally the top of a plurality of end-to-end tables and in operation the cloth spreading apparatus is moved from a first location adjacent one end of the work surface to a second location adjacent the other end of the work surface.

The cloth roll assembly consists of a roll of cloth 16 which is typically supported by a paperboard core 18. In order to properly support the roll of cloth and its core for use in the apparatus of this invention and expandable mandrel indicated generally at 20 is inserted into the core 18, portions 22 (FIG. 10) of the mandrel being expanded into firm engagement with the core 18 so that in operation the mandrel and cloth roll will rotate together. Additional features of the mandrel will be described below.

The cloth spreading apparatus includes, in addition to the mandrel, a more or less conventional carriage assembly indicated generally at 24, upon which is mounted a mounting frame assembly indicated generally at 26, and various other components such as a knife box 28 and control panel 30. The carriage assembly 24 is provided with means for supporting it for linear motion between the first and second locations and in the embodiment illustrated the supporting means consists of four rollers 32 which rest upon the surface 14. The front rollers 32 may engage a track upon the surface 14. The rollers may be driven to cause the carriage to move between the first and second locations, or alternatively, in the illustrated embodiment, the carriage can be hand propelled by engaging handles 34 for this purpose.

The carriage assembly 24 has front and rear vertically extending side frame assemblies 36, 38, respectively, and a top box frame assembly. The front rear and top frame assemblies, when assembled to each other leave a generally inverted U shaped appearance when viewed from one end of the tables as can be seen from FIG. 6. The top box frame assembly includes left and right C-section cross frame members **40*l*, 40*r*, respectively, which extend between the side frame assemblies 36 and 38** and are rigidly secured to the side frame assemblies.

Rigidly secured to the bottom of members 40*l* and 40*r* is a sheet metal plate 42, and a sheet metal plate 44 is disposed above the frame members 40, the plate 44 being rigidly secured to the members 40 and is additionally provided with a rectangular cutout 45. Supported on the upper surface of the metal plate 44 and rigidly secured to the member 40*l* are laterally outwardly extending bearing blocks 46 for slidably supporting front and rear coaxial pivot shafts 47*f*, 47*r*, respectively of a pivot shaft assembly 48. Adjacent ends of the shafts 47 are rigidly secured to an intermediate screw journal block 49. As can be seen from FIGS. 1–3, the side frames 36 and 38 are each provided with extensions 50 to which the left hand wheels or rollers 32 are secured. Disposed to the other side of the frames 36 and 38 are vertically extending elements 52 to which the knife box 28 is adjustably secured, a hand wheel 54 permitting manual adjustment. The full manner in which the knife box is adjusted forms no part of the present invention, and one manner in which the knife box may be adjusted is disclosed in U.S. Pat. No. 3,233,488, the subject matter of which is incorporated herein by reference thereto.

Disposed above the front rod 52 is an L-shaped bracket 56 which supports at its outer end edge sensing means 58 which may be in the form of an electric eye or the equivalent. Supported on the other end of the L-shaped bracket 56 is a housing 60 for a pivot block and potentiometer. Another bracket 62 which is supported on the upper end of the rear side frame assembly 38 also supports a housing 64 which housing incorporates a pivot block and spring mechanism 65 (FIG. 9). A dancer bar 66 is supported at one end of a pair of arms 68, the arms in turn carrying shaft 70 at its other end, the shaft being pivotally received within the pivot blocks of housings 60 and 64. The spring mechanism 65 within the housing 64 will normally bias the dancer bar in the opposite direction to that indicated by the arrow 72 in FIG. 10 and the potentiometer within housing 60 will sense the position of the dancer bar. The dancer bar 66 and potentiometer within housing 60 act as tension sensing means in a manner which will be more fully brought out below. The optimum tension position is normally set where the dancer bar is midway between its range of travel.

Mounted to the bottom of the metal plate 44 is a reversible electric motor 74, the output shaft of which is coupled to a right angle reduction gear box 76. A sprocket 78 is coupled to the output shaft 80 of the gear box 76. Another sprocket 82 is journalled about a clevic pin 84 on clevic 86, the clevic 86 in turn being secured to the rear side frame assembly 36 by fasteners 88. A chain 90 passes over the sprockets 78 and 82 and is driven by the motor 74 through gear box 76. Pinned to the chain 90 is a lug 92, the purpose of which will be explained hereinafter.

The roll mounting frame assembly 26 as previously noted is mounted on the carriage 24. The frame assembly can be shifted in its entirety towards and away from the front side frame assembly 36. The mounting frame assembly has a subassembly including a first portion which is pivotal about an axis transverse to the direction of the movement of the carriage assembly 24 as it moves between the first and second locations, the first portion being indicated generally at 94, and a second cloth roll supporting portion indicated generally at 96 which is mounted on the first portion and which is rotatable 180° about a perpendicularly extending axis.

The first portion 94 includes a principal frame member or platform 98 which could be either a relatively thick wooden member or a honeycomb metal frame construction. Five pivot block assemblies 100 are rigidly secured to the left hand edge of the principal frame member 98 and extend downwardly therefrom. The shafts 47 of the pivot shaft assembly 48 pass through the pivot blocks and thus the first portion 94, as well as the second portion 96 of the mounting frame assembly 26 can pivot from the full line position shown in FIG. 2 to the phantom line position shown in the same figure.

The roll mounting frame assembly includes, in addition to the first and second portions 94, 96, a motor driven screw operated scissors jack assembly, indicated generally at 102, which is provided to cause the portions 94 and 96 to pivot about the shaft assembly 48. When spreading cloth the assembly or operating means 102 is disposed entirely below the platform 98, and a portion is received within cutout 45. However, the platform 98 is provided with a small cutout 104 to prevent interference when the platform is in its loading or unloading position shown in phantom lines in FIG. 2. The operating means 102 include a jack motor 108 which is preferably a reversible electric motor. The output shaft of the motor 108 is coupled to a worm which drives a worm gear in gear housing 110, the worm and worm gear not being shown. The gear housing is in turn secured to the screw journal block 49. The worm gear shaft in housing 110 is coupled to a ball screw 112, the ball screw passing through the journal block 49 and carrying a thrust bearing which engages the journal block.

In order to support the mounting frame assembly for front to rear sliding movement, the carriage is additionally provided with a further shaft parallel to the shafts 47. To this end, a pair of spaced apart shaft mounting blocks 114 are disposed on the upper surface of plate member 44 above the right C-section cross frame member 40*r*. The mounting blocks 114 in turn support shaft 116 which is parallel to the pivot shaft assembly 48. A linear bearing block 118, which is part of the mounting frame assembly, is carried by the shaft 116 for movement towards and away from one of the mounting blocks 114. A bracket 120 is rigidly secured to the linear bearing block. The ends of the bracket are in turn rigidly secured to one end of front and rear parallel straps 122, 124, the other ends of the straps being journalled about the shafts 47*f*, 47*r*, respectively and being held adjacent the screw mounting block 49 by C-washers (not shown). Rigidly secured to intermediate portions of the front and rear straps 122, 124 are downwardly extending pivot shaft mounting members 126 which receive a shaft 128. The slidable or shiftable subframe 118, 120, 122, 124, 126 and 128 of the mounting frame assembly can neither pivot nor rotate, but only serves to slidably support the operating means 102 and the first pivotal portion 94 and the second rotatable portion 96.

Figure 11:
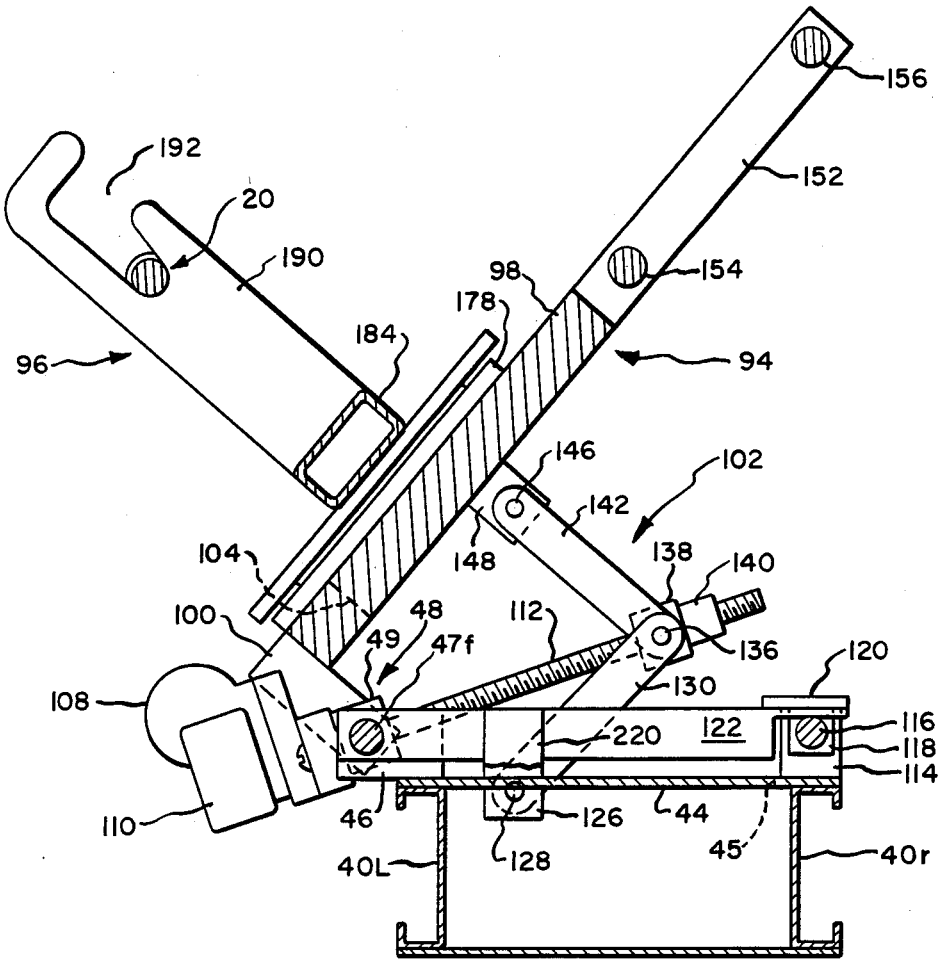
FIG. 11 is a view somewhat similar to FIG. 5 but showing additional details in combination.

The operating means 102 further includes a scissors linkage formed of a plurality of pivotal linkings. Thus, front and rear lower links 130, 132 are journalled about the shaft 128 and are held apart by a spacer 134. The upper right hand ends of the links 130, 132 are journalled about stub shafts 136 extending to either side of block 138 to which a ball screw nut 140 is carried, the ball screw 112 passing through the block 138 and being journalled within the ball screw nut 140. The lower right hand ends of front and rear upper links 142, 144 are also journalled about the stub shafts 136. The left upper end of the links 142, 144 are journalled about stub shafts 146 carried by mounting block 148 which is in turn rigidly secured to the lower surface of the platform or principal frame member 98. It can be seen from FIG. 11 that if the screw is rotated in a first direction to cause the nut to be moved towards the right hand end of the screw, the platform will be shifted in a clockwise direction to its normal operative position. Similarly, if the screw is rotated in the opposite direction, the platform will be shifted to the position shown in phantom lines in FIG. 2.

The first portion of the mounting frame 94 also includes front and rear normally horizontally extending arms 150, 152, the left hand end portion of these arms being rigidly secured to front and rear edges of the platform 98. Left and right rollers 154, 156 are carried by the arms 150, 152. As can be seen from FIG. 10 the cloth when being spread will pass over the rollers 154, 156 as well as the dancer bar 66. As the tension of the cloth increases, the dancer bar 66 will be moved in a direction opposite the arrow 72, and similarly, when the tension decreases, the dancer bar will move in the direction of the arrow 72. Mounted upon the left hand ends of the arms 150, 152 are upwardly extending front and rear masts 158, 160. The front mast carries a latch 162 which is normally spring biased towards the rear mast 160 by spring 164 in latch housing 166. A handle 168, the lower end of which is pivotally secured to the front mast 158 by pivot block assembly 170, is connected to the latch 162 by links 172. By pulling the handle towards the operator who is standing in front of the machine, the latch can be released.

The rear mast 160 is provided with a cutout 174, the vertical surface of which acts as a stop. Disposed adjacent the stop on the exterior surface of the mast 160 is a switch 176.

The bottom half 178 of a turntable is secured to a central location of the platform 98 by fasteners 180. The top half 182 of the turntable, which forms the base of the second portion 96 of the mounting frame assembly 26, is secured to a cross beam member 184 of the second portion 96. All of the other portions of the second portion of the mounting frame are carried by the cross beam member 184 and thus the second portion can rotate 180° about an axis 186, which is perpendicular to the platform 98, between a first operative position (FIG. 2) and a second operative position. A pair of arms 188, 190 are rigidly mounted on the ends of the cross beam member 184 by welding or by any other suitable manner. Each of the arms is provided with a J-shaped slot 192 adjacent its remote end. When the arms 188 and 190 are suitably positioned for movement toward their loading or unloading position, as shown in FIG. 1, arm 188 will be positioned at the front of the machine and arm 190 will be positionied at the back of the machine. The arms are of a suitable strength that they are capable of supporting a cloth roll assembly which may weight several hundred pounds. Disposed midway between the ends of each of the arms 188, 190 is a stop 194. Disposed to the right hand side of the stop 194 and spaced away from the stop a distance sufficient to receive the latch 162 is a cam member 196. The purpose of the stop 194 and cam 196 is to permit the latch to hold either arm in an operative position but which will permit the second cloth roll supporting portion 96 to rotate 180° to its other operative position, the latch 162 riding up the angled surface of the cam 196 until it falls into the slot between the cam block 196 and the stop 194 thereby preventing further rotation. The arm 190 is provided with a second stop 198 disposed between the cam 196 and the J-slot 192, the second stop engaging the vertical wall of cutout 174 in the rear mast 160 to prevent more than 180° of rotation. An extension of the stop 198 will also engage switch 176.

In order to further control rotation of the cloth roll supporting portion 96, resilient means in the form of a horizontal cantilever spring 200 is provided. The spring 200 has one end rigidly secured to the top surface of platform 98 adjacent the bottom half 178 of the turntable. The free end of the cantilever spring is adapted to contact a roller carried by the beam member 184 and to this end there is a pair of rollers 202, 204 extending below the bottom surface of the beam 184, the roller 202 being disposed adjacent arm 188 and roller 204 being disposed adjacent arm 190. When the parts are in the full line position shown in FIG. 3, the latch 162 will be held within the slot between stop 194 and cam 196 and the spring 200 will be flexed to the right. When the latch 162 is released the action of the spring will initially move the beam 184 in a clockwise direction indicated by arrow A and after a slight additional acceleration is imparted to the beam by the operator, the beam will swing almost 180° until the roller 204 engages the spring 200 moving it to the left of its centered position and at the same time decelerating the rotational movement of the second portion of the mounting frame. As the 180° movement is being completed the latch 162 will ride over the cam 196 on arm 190 until it falls into the slot between the cam 196 and the stop 194 thereby completing the rotational movement of the second portion. When the latch is now released, the spring 200 will cause the beam to initially be accelerated in a direction opposite to the arrow A. As can best be seen from FIG. 3, the rollers 202 and 204 are off set from the center line of the beam 184. The purpose of the offset is to facilitate the operation of the resilient means.

Mounted on the arm 188 just below the J-slot 192 is a worm gear (not shown) mounted within housing 206. The housing is rigidly secured to the arm, and the output shaft for the worm gear passes through a suitable aperture in the arm and a spur gear 208 is mounted on the end of the output shaft. The worm gear can be caused to be rotated by a worm driven by a permanent magnet DC motor 210, the motor in turn being rigidly secured to the housing 208. The purpose of the motor and gear is to either drive the cloth roll assembly or to brake the cloth roll assembly. To this end it should be noted that the expandable mandrel is provided with a gear 212 which can engage the spur gear 208 when the cloth roll assembly is raised to its operative position shown in full lines in FIG. 2. To insure that the gear 212 on mandrel 20 is properly located, the mandrel is further provided with locating grooves 213 which grooves are engaged by the J-slots.

In operation the cloth spreading apparatus will normally be in the position shown in FIG. 1 prior to loading. By operating 3-position switch 214 by moving it from its spring centered "off" position to its "lower" position, the jack motor 108 will be operated to cause the screw 112 to rotate in that direction which will cause the ball screw 112 to rotate in that direction mounting block 49. This operation will cause the platform and that structure supported by the platform to pivot about shafts **47*f* and 47*r* until the arms are in the phantom position shown in FIG. 2. Operation of the jack motor will be stopped either by the operator releasing the switch, which will then be spring biased back to its "off" position, or by the limit switch 216 being contacted by the pivoting portion of the mounting frame assembly. The whole carriage assembly 24 will now be moved to the left until the mandrel is disposed within the J-slot with the grooves 213 in the mandrel being in proper alignment with the arms. If the grooves are not initially in proper alignment, it will be necessary to reposition the cloth roll assembly into which the expandable mandrel has previously been inserted and expanded. Once the mandrel is properly positioned within the J-slot the motor 108 will be run in a reverse direction by moving switch 214 to its "raise" position, the reverse operation of motor 108 causing the arms and platform assembly to resume their normal operative position shown in full line in FIG. 2 with the cloth roll assembly now being supported by the arms 188, 190. As the arms swing up the cloth roll assembly will shift within the J-slots causing the gear 212 to become engaged with the gear 208. Operation of the jack motor when raising the arms will be stopped when the limit switch 218 is contacted, at which time the operator will release switch 214. The cloth from the roll is now passed over the left roller 154, below the dancer bar 66, above the right roller 156 and through the knife box 28. Cloth can now be spread on the surface 14. If the tension on the cloth is too great the prefeed motor 210 will be caused to be operated to rotate the cloth roll in a suitable direction to decrease the tension on the cloth. Thus, if the parts are in the position shown in FIG. 10, with the cloth being fed from under the mandrel 20, as would be the case when the cloth roll supporting portion is in its first operative position, the cloth roll would be rotated in the counterclockwise direction. Similarly, if the tension starts to drop, as would be the case when the carriage is being decelerated adjacent one of its two end positions, the motor 210 will be caused to be braked, either by reversing the polarity of the armature, or alternatively by shorting out the motor. The operation of the motor is controlled by the potentiometer within housing 60 and also by limit switch 176. It should be noted that when the second portion of the mounting frame is swung from the first position shown in FIG. 1 180° to the second position that the switch 176 will no longer be contacted. Thus, when limit switch 176 is closed, as would be the case when the cloth roll supporting portion 96 is in its first operative position, sensed tension above the desired tension will cause motor 210 to rotate roll 16 in a counterclockwise direction. Similarly, when limit switch 176 is open, as would be the case when the second portion 96 is in its second operative position, excess tension sensed by the tension sensing means will cause the motor 210 to rotate roll 16** i a clockwise direction.

During the laying of the cloth the edge sensor 58 will sense the edge of the cloth and will cause the shifting motor 74 to be operated in a manner well known to those skilled in the art. In this connection it should be noted that the lug 92 is interconnected with a downwardly extending bracket 220 (FIG. 6) carried by front strap 122. (The bracket 220 may be an extension of member 126.) The parts are so designed that there is at least four inches of sliding movement of the mounting frame subassembly.

After one cloth has been laid it may be desirable to cut the material, reverse the roll and again lay the cloth as the carriage moves in the other direction so that the same surface of the cloth is always in the "up" position. The reversing of the roll is accomplished merely by releasing the latch 162 by pulling on handle 168, and then swinging the second portion of the mounting means 180° until it is fully engaged in its other position. The cloth is then passed over rollers 154 and 156, below dancer bar 66 and into knife box 28 as before. The carriage will now be moved in the other direction until it attains its other location. At this point the cloth is again cut, the second portion is rotated 180° and the previous steps of threading the cloth are repeated. The switch 176 has an additional function of preventing the operation of the jack motor when the switch is open. In other words, the switch 176 must be closed before the jack motor 108 can be operated and thus, the open portion of the J-hooks must always face to the right before the jack can be operated.

Figure 2:
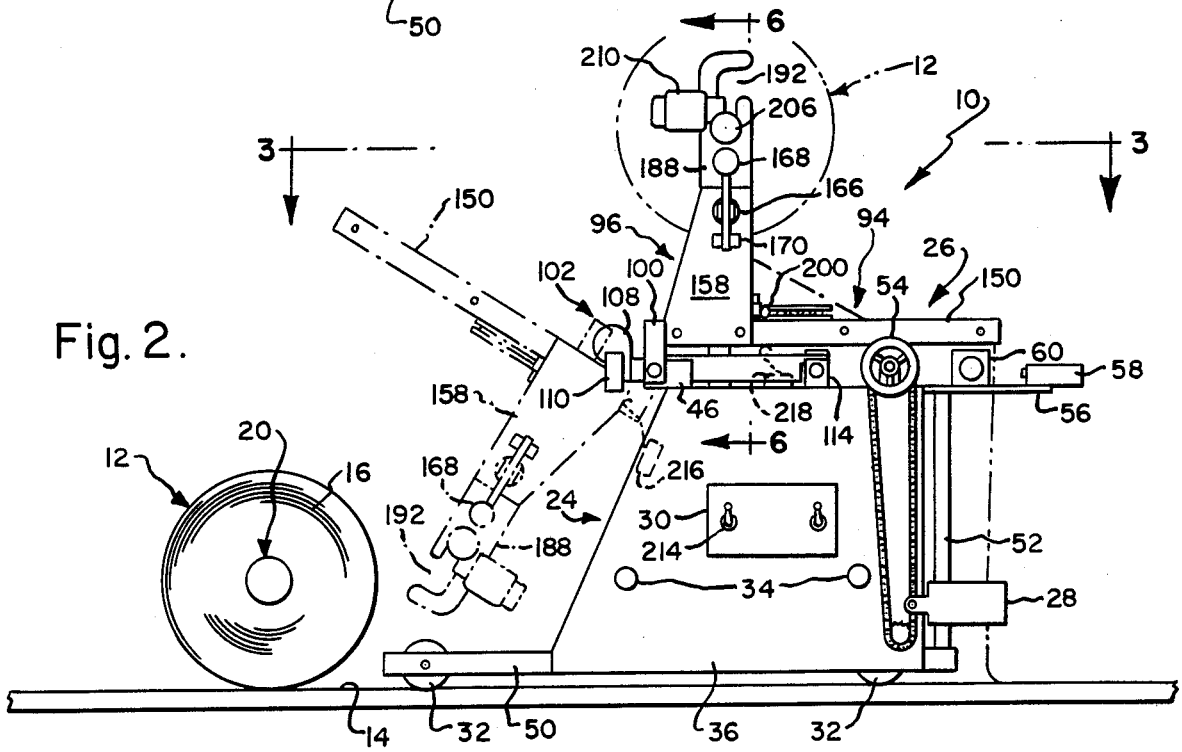
FIG. 2 is a side elevational view of the apparatus shown in FIG. 1 showing in phantom lines a portion of the apparatus in a cloth roll assembly loading position.
Figure 4:
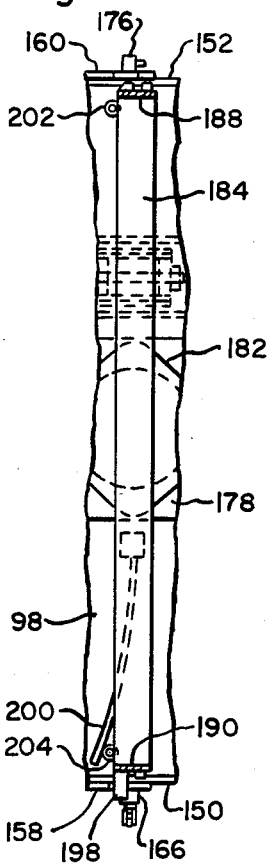
FIG. 4 is a top plan view of a portion of the apparatus showing the turntable portion in its second position.
Figure 3:
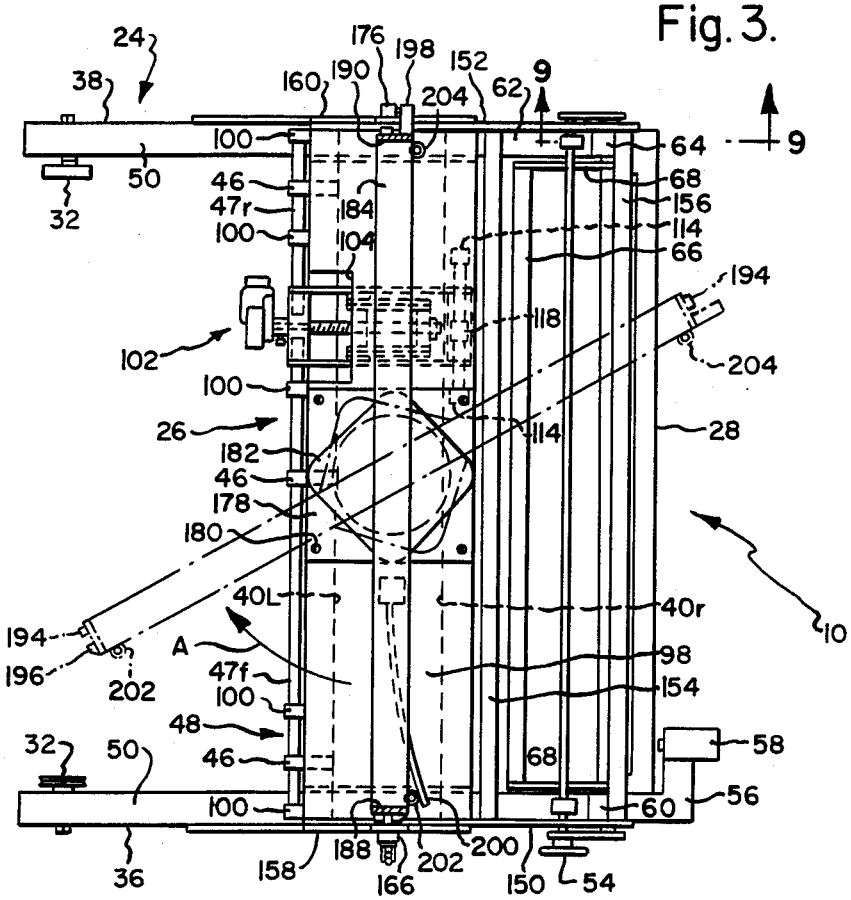
FIG. 3 is a view taken generally along the line 3—3 in FIG. 2 and additionally showing in phantom lines the rotatable turntable portion in an intermediate position.
Figure 5:
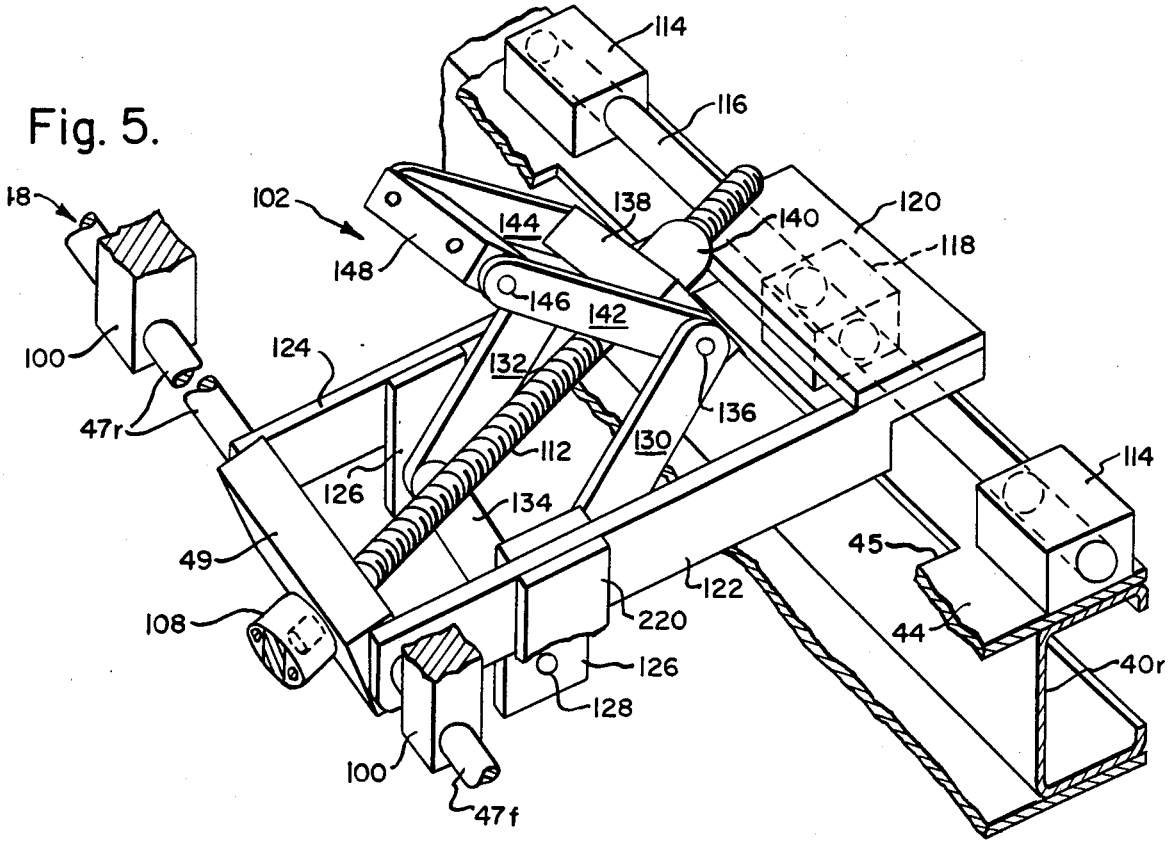
FIG. 5 is a perspective view showing the mechanism for shifting cloth roll assembly loading arms between their raised operative cloth roll assembly supporting position and their lowered cloth roll assembly loading or unloading position.

To discharge the cloth roll assembly from the arms 188, 190, it is only necessary to again operate the jack motor to cause the platform 98 and the parts carried thereby to pivot about shafts 102, 104 until the assembly is again in the dotted line position shown in FIG. 2. As the assembly moves towards this position the mandrel will shift in the J-slot disengaging the gear 212 from gear 208. It is now only necessary to move the carriage to the right if the cloth roll is of a sufficient diameter to support itself on the surface. In the event that the diameter is not sufficient due to the fact that most of the cloth has been spread from the roll it will be only necessary to lift the mandrel from the J-slot which can be readily done since the cloth roll assembly will only have a minimal weight.

While a preferred structure in which the prints opposes this invention has been incorporated as shown and described above, it is to be understood that the invention is not to be limited to the particular details shown and described above, but that, in fact, widely differing means may be employed in the practice in the broader aspects of this invention.

What is claimed is:

1. A cloth spreading apparatus for spreading a plurality of superimposed layers of cloth from a cloth roll assembly onto a transversely extending work surface, said apparatus comprising a carriage assembly at least partially supported on a work surface and capable of being moved across the work suface between first and second locations; and a mounting frame assembly supported on said carriage and including a subassembly pivotal about an axis transverse to the direction of movement of said carriage assembly, said subassembly including a pair of spaced apart outwardly extending arm means, said arm means being capable of supporting a cloth roll assembly and being movable with the subassembly between an upright operative cloth spreading position and a downwardly extending cloth roll assembly loading and unloading position, and operating means capable of causing said subassembly to pivot about said axis so as to cause said arm means to be moved between said upright operative cloth spreading position and said downwardly extending cloth roll assembly loading and unloading position, said operating means including a screw operated scissors jack assembly.

2. The cloth spreading apparatus as set forth in claim 1 wherein the mounting frame assembly further includes a slidable subframe mounted upon said carriage assembly for sliding movement in a direction transverse to the direction of movement of the carriage assembly.

3. The cloth spreading apparatus as set forth in claim 2 wherein the screw operated scissors jack includes a first pair of links pivoted at one end to the slidable subframe, a second pair of links pivotally secured at one end to said pivotal subassembly, a shaft assembly interconnecting the other ends of said pivoted links to each other, said shaft assembly including a nut, and screw means, one portion of said screw means being rotatably journalled in a pivotal portion of the slidable subframe assembly and the other portion of said screw being received within said nut.

4. The cloth spreading apparatus as set forth in claim 3 further characterized by the provision of an electric motor and gear assembly operatively interconnected with said screws means and capable of rotating said screw means upon energization of the motor, said motor and gear assembly being mounted on said pivotal portion of said slidable subframe.

5. A cloth spreading apparatus for spreading a plurality of superimposed layers of cloth from a cloth roll assembly onto a transversely extending work surface, said apparatus comprising:

a carriage assembly at least partially supported on a work surface and capable of being moved across the work surface between first and second locations;

a mounting frame assembly carried by said carriage assembly and including a cloth roll supporting portion having a pair of spaced apart arm means;

tension sensing means carried by said carriage assembly and capable of sensing the tension of the cloth being spread; and prefeed motor means associated with one of said arm means and engageable with said cloth roll assembly to either prefeed cloth from said cloth roll assembly or to brake said cloth roll assembly in response to the sensed tension.

6. The cloth spreading apparatus as set forth in claim 5 wherein said portion of the frame assembly is rotatable about a generally vertically extending axis to permit rotation of said portion about 180°.

7. The cloth spreading apparatus as set forth in claim 5 wherein said portion of the frame assembly is pivotal about an axis transverse to the direction of movement of said carriage assembly to permit said pair of spaced apart arm means to be moved between an upright operative cloth spreading position and a downwardly extending cloth roll assembly loading and unloading position.

8. The cloth spreading apparatus as set forth in claim 5 wherein said portion of the frame assembly is both rotatable about a generally vertically extending axis to permit rotation of said portion about 180°.

9. The cloth spreading apparatus as set forth in claim 7 wherein said portion of the frame assembly is slidable in a direction transverse to the direction of movement of said carriage assembly.

10. The cloth spreading apparatus as set forth in claim 5 wherein the prefeed motor means includes a reversible permanent magnet DC motor.

11. The cloth spreading apparatus as set forth in claim 10 wherein a potentiometer is associated with said tension sensing means, said potentiometer causing the DC motor to be shorted when the sensed tension is less than the desired amount to cause said motor to dynamically brake the cloth roll assembly.

12. The cloth spreading apparatus as set forth in claim 5 wherein the cloth roll assembly includes an expandable mandrel rotatable with the cloth roll assembly, and wherein the prefeed motor means engages said expandable mandrel.

13. The cloth spreading apparatus as set forth in claim 12 wherein said portion of the frame is pivotal about an axis transverse to the direction of movement of said carriage assembly to permit said pair of spaced apart arm means to be moved between an upright operative cloth spreading position and a downwardly extending cloth roll assembly loading and unloading assembly, each of said pair of spaced apart arm means being provided with a J-slot engageable with spaced apart portions of said expandable mandrel, the prefeed motor means including an output gear disposed adjacent one of said slots, and the expandable mandrel including a gear engageable with the output gear when the arms are in the upright operative cloth spreading position, said output gear and the gear on the expandable mandrel being disengaged when the arms are in their downwardly extending position.

14. A cloth spreading apparatus for spreading a plurality of superimposed layers of cloth from a cloth rol assembly onto a transversely extending work surface; said apparatus including a carriage assembly at least partially supported on a work surface and capable of being moved across the work surface between first and second locations;

a mounting frame assembly supported on said carriage assembly;

a mandrel carried by said mounting frame assembly, said mandrel being assembled to a cloth roll for rotation therewith;

tension sensing means on said carriage assembly capable of sensing the tension of the cloth being spread; and electric prefeed motor means coupled to said mandrel and capable of either driving said mandrel when the sensed tension in the cloth being spread is excessive or dynamically braking said mandrel when the sensed tension in the cloth being spread is insufficient.

15. The cloth spreading apparatus as set forth in claim 14 wherein said mounting frame includes a rotatable portion which is rotatable 180° about a perpendicularly extending axis, said mandrel and cloth roll assembly being supported by said rotatable portion, and wherein said electric prefeed motor means is reversible.

16. The cloth spreading apparatus as set forth in claim 15 wherein a pair of spaced apart arm means are carried by said rotatable portion, said mandrel being carried by said spaced apart arm means, and wherein the electric prefeed motor means is carried by one of said pair of arm means.

17. The cloth spreading apparatus as set forth in claim 16 wherein said mounting frame further includes a pivotal portion which is pivotal about an axis transverse to the direction of movement of said carriage assembly, said rotatable portion being carried by said pivotal portion to permit said pair of spaced apart arm means to be moved between an upright operative cloth spreading position and a downwardly extending cloth roll assembly loading and unloading position.

18. The cloth spreading apparatus as set forth in claim 17 wherein said mounting frame further includes a slidable portion which is slidable in a direction transverse to the direction of movement of the carriage assembly as it is moved across the work surface, said pivotal portion being carried by said slidable portion.

19. A cloth spreading apparatus for spreading a plurality of superimposed layers of cloth from a cloth roll assembly onto a transversely extending work surface; said apparatus including:

a carriage assembly at least partially supported on a work surface and capable of being moved across the work surface between first and second locations;

a mounting frame assembly supported on said carriage assembly and including a pair of spaced apart outwardly extending arm means mounted for movement between an upright operative cloth spreading position and a downwardly extending position for loading and unloading a cloth roll assembly, each of said arms being provided with a J-slot;

a mandrel disposed within a cloth roll for rotation therewith, spaced apart portions of the mandrel being engaged by said J-slots when the cloth roll and mandrel assembly is loaded onto the mounting frame;

a prefeed motor means having an output engageable with said mandrel and capable of driving said mandrel to prefeed cloth from said roll; and tension sensing means supported on said carriage assembly and capable of sensing the tension in the cloth being spread and operatively interconnected with the prefeed motor means in such a manner that the prefeed motor means is caused to be driven in a first direction to cause cloth to be discharged from the cloth roll assembly when the cloth tension is excessive.

20. The cloth spreading apparatus as set forth in claim 19 wherein the prefeed motor means is also capable of dynamically braking the cloth roll assembly when the cloth tension is insufficient.

21. The cloth spreading apparatus as set forth in claim 20 wherein the prefeed motor means includes a reversible permanent magnet DC electric motor and wherein the tension sensing means is capable of either reversing the polarity of the armature of the DC motor or shorting out the DC motor to effect dynamic braking.

22. The cloth spreading apparatus as set forth in claim 20 wherein said mounting frame assembly includes a rotatable portion and a nonrotatable portion, said rotatable portion being rotatable 180° said pair of spaced apart outwardly extending arm means being mounted on a rotatable portion, and further characterized by the provision of a stop element carried by said rotatable portion, and switch means carried by the nonrotatable portion, said switch means being contacted by the stop element when the rotatable portion of the mounting frame assembly is in a first position of 180° rotation to cause said DC motor to be driven in a first direction when prefeeding, and when the rotatable portion is in a second position of 180° rotation, the switch means not being contacted whereby the prefeed motor means is caused to be driven in a reverse direction when prefeeding cloth.

23. The cloth spreading apparatus as set forth in claim 22 further characterized by the provision of jack motor means including an electric motor which is capable of causing the pair of spaced apart outwardly extending arm means to be moved between their upright and downwardly extending positions, and wherein said switch means will prevent the operation of the electric motor of the jack means when not contacted.

24. The cloth spreading apparatus as set forth in claim 19 wherein the prefeed motor means is mounted on one of said pair of arm means and has an output gear adjacent an end of the J-slot on said arm means, and wherein the mandrel is provided with a spur gear engageable by said output gear when said pair of arm means are in their upright operative cloth spreading position.

25. The cloth spreading apparatus as set forth in claim 24 wherein the mandrel is provided with a pair of spaced apart locating grooves engageable by the J-slots in said pair of arms means, the spur gear on the mandrel being located adjacent one of said locating grooves.

26. A cloth spreading apparatus for spreading a plurality of superimposed layers of cloth from a cloth roll assembly onto a transversely extending work surface, said apparatus comprising:

a carriage assembly at least partially supported on a work surface and capable of being moved across the work surface between first and second locations; and a mounting frame assembly supported on said carriage assembly and including a subassembly including a first portion pivotal about a first axis transverse to the direction of movement of said carriage and a second portion mounted on the first portion and rotatable 180° between first and second operative positions about a second axis perpendicular to the first portion, said second portion including a pair of spaced apart outwardly extending arm means capable of supporting a cloth roll assembly, and operating means capable of causing said first and second portions of the frame assembly to pivot about said transverse axis so as to cause the arm means to be moved between an upright operative cloth spreading position and a downwardly extending cloth roll assembly loading and unloading position.

27. The cloth spreading apparatus as set forth in claim 26 wherein switch means are provided to sense the position of the second portion of the subassembly, said switch means being capable of preventing the operation of the operating means except when the second portion is in its first operative position.

28. The cloth spreading apparatus as set forth in claim 26 wherein said first portion is mounted on a subframe which is slidable in a direction parallel to said first axis.

29. The cloth spreading apparatus as set forth in claim 28 further characterized by the provision of shifting motor means coupled to said subframe and capable of shifting the subframe and subassembly parallel to said first axis, and additionally characterized by the provision of an edge sensing means capable of sensing the position of the edge of the cloth being spread and operatively interconnected with the shifting motor means in such a manner that the shifting motor is caused to be driven to properly shift the subframe and subassembly to maintain proper edge positioning.

30. The cloth spreading apparatus as set forth in claim 28 wherein the operating means includes a screw jack assembly, one portion of the screw jack assembly being connected to said subframe and another portion being interconnected to said first portion.

31. The cloth spreading apparatus as set forth in claim 26 wherein said first portion includes a pair of outwardly extending masts, the pair of spaced apart outwardly extending arm means being disposed closely adjacent and within said masts, wherein one of said masts includes a latch, and wherein each of said arms means includes a portion engageable by said latch to maintain said second portion in either the first or second position.

32. The cloth spreading apparatus as set forth in claim 31 wherein switch means are provided to prevent the operation of the operating means except when the first portion is in its first position, said switch means being carried by one of said masts, and further characterized by one of said pair of spaced apart outwardly extending arm means carrying a stop which engages said switch means only when the second portion of the subassembly is in its first position.

33. A cloth spreading apparatus for spreading a plurality of superimposed layers of cloth from a cloth roll assembly onto a transversely extending work surface, said apparatus comprising a carriage assembly at least partially supported on a work surface and capable of being moved across the work surface between first and second locations; and a mounting frame assembly supported on said carriage assembly and including a pivotal portion, a cloth roll supporting portion mounted on the pivotal portion and rotatable 180° between first and second positions about a generally perpendicularly extending axis, and resilient means extending between said cloth roll supporting portion and said pivotal portion of said mounting frame assembly and capable of initially accelerating said cloth roll supporting position as it moves away from either the first position or the second position and of decelerating said cloth roll supporting portion as it approaches either the first position or the second position.

34. The cloth spreading apparatus as set forth in claim 33 wherein the resilient means includes a horizontally extending cantilever spring bar carried by said nonrotatable portion.

35. The cloth spreading apparatus as set forth in claim 34 wherein said cloth roll supporting portion includes a pair of spaced apart rollers, one of said rollers being contacted by the free end of said spring when the cloth roll supporting position is in one of its first or second positions of operation.

36. The cloth spreading apparatus as set forth in claim 35 wherein the pivotal portion includes a pair of spaced apart outwardly extending masts, one of said masts carrying a latch, wherein the cloth roll supporting portion includes a pair of outwardly extending arms which support the cloth roll assembly, each of said arms being provided with latch receiving means in the form of a stop and spaced apart cam member.

* * * * *